US011635778B2

(12) United States Patent
Jiang et al.

(10) Patent No.: US 11,635,778 B2
(45) Date of Patent: Apr. 25, 2023

(54) VOLTAGE REGULATOR CIRCUIT

(71) Applicant: Apple Inc., Cupertino, CA (US)

(72) Inventors: Yongjie Jiang, Santa Clara, CA (US); Pablo Moreno-Galbis, Burlingame, CA (US); Stanley Bo-Ting Wang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 335 days.

(21) Appl. No.: 17/033,494

(22) Filed: Sep. 25, 2020

(65) Prior Publication Data

US 2022/0100217 A1 Mar. 31, 2022

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ... G05F 1/10; G05F 1/46; G05F 1/467; G05F 1/56; G05F 1/561; G05F 1/575; G05F 1/59; G05F 3/26; G05F 3/262; G05F 3/242
See application file for complete search history.

(56) References Cited

U.S. PATENT DOCUMENTS 5,982,226 A * 11/1999 Rincon-Mora ..... G05F 3/242 323/280
6,703,815 B2 3/2004 Biagi
7,656,139 B2 2/2010 van Ettinger
8,232,782 B2 7/2012 Houston et al.
9,306,522 B2 4/2016 Kronmueller
10,802,517 B1 * 10/2020 Assaad ..... G05F 1/468
2005/0184711 A1 * 8/2005 Chen ..... G05F 1/575 323/280
2012/0212200 A1 * 8/2012 Amer ..... G05F 1/575 323/282
2017/0315574 A1 * 11/2017 Brown ..... G05F 1/468
2019/0258282 A1 * 8/2019 Magod Ramakrishna ..... G05F 1/575
2020/0293075 A1 * 9/2020 Enam ..... G05F 1/565
2021/0373588 A1 * 12/2021 Wang ..... G05F 1/59
2021/0397207 A1 * 12/2021 Joo ..... G05F 1/575

FOREIGN PATENT DOCUMENTS

EP 1569062 A1 * 8/2005 ..... G05F 1/575

* cited by examiner

*Primary Examiner* — Thienvu V Tran
*Assistant Examiner* — Shahzeb K Ahmad
(74) *Attorney, Agent, or Firm* — Kowert, Hood, Munyon, Rankin & Goetzel, P.C.; Erik A. Heter; Dean M. Munyon

(57) ABSTRACT

A voltage regulator circuit is disclosed. The voltage regulator includes a feedback circuit configured to generate a feedback signal based on a voltage level present on a regulated power supply node. A comparison circuit is arranged to generate an error signal based on the feedback signal and a reference voltage level. A compensation circuit is configured to modify the error signal, based on a routing impedance coupled between the regulated supply voltage node and a load circuit, to generate a control circuit. An output circuit of the voltage regulator is configured to source current to the regulated power supply node based on the control signal.

20 Claims, 10 Drawing Sheets

- Current Density of I1 (through M10) = Current Density of I2 (through M11), therefore, no current through R1 and R2

- Capacitor C2, In Parallel with R1, Implements a Lower Frequency Pole and a Higher Frequency Zero

VOLTAGE REGULATOR CIRCUIT

BACKGROUND

Technical Field

This disclosure is directed to electronic circuits, and more particularly, to voltage regulator circuits.

Description of the Related Art

Voltage regulators are commonly used in a wide variety of circuits in order to provide a low ripple regulated desired voltage to analog/digital circuits. To this end, a wide variety of voltage regulator circuits are available to suit various applications. Linear voltage regulators are used in a number of different applications in which the available supply voltages exceed an appropriate value for the circuitry to be powered. Accordingly, linear voltage regulators may output a voltage that is less than the received supply voltage.

One type of linear voltage regulator is the low dropout (LDO) regulator. An LDO voltage regulator may operate to provide an output voltage that is very close to the received supply voltage. Furthermore, LDO voltage regulators may be relatively simple in design in comparison with some other types of voltage regulators, such as buck or boost converters which require switching among multiple voltage regulation phases.

A voltage regulator circuit is disclosed. In one embodiment, the voltage regulator includes a feedback circuit configured to generate a feedback signal based on a voltage level present on a regulated power supply node. A comparison circuit is arranged to generate an error signal based on the feedback signal and a reference voltage level. A compensation circuit is configured to modify the error signal, based on a routing impedance coupled between the regulated supply voltage node and a load circuit, to generate a control signal. An output circuit of the voltage regulator is configured to source current to the regulated power supply node based on the control signal.

In one embodiment, the compensation circuit introduces compensation poles that can track the parasitic zeros in a transfer function of the voltage regulator. The respective frequencies the zero are dependent on the routing impedance. However, the pole and the zero may maintain the same or similar relation to one another irrespective of the routing impedance. Accordingly, for different applications, the relationship between the pole and the zero of the pair may track one another, with both being affected by the routing impedance in a similar manner.

In one embodiment, the voltage regulator also includes a gain control circuit. The gain control circuit may provide bandwidth control by controlling gain using a pair of resistors. The voltage across the resistors are maintained a nearly constant value with a local feedback circuit irrespective of an output current provided by the voltage regulator. One of the resistors may be coupled in parallel with a capacitor that implements a lower frequency pole and a higher frequency zero of another pole-zero pair. This may allow higher DC/AC gain below the frequency of the pole without significant degradation of the phase margin of the circuit.

BRIEF DESCRIPTION OF THE DRAWINGS

The following detailed description makes reference to the accompanying drawings, which are now briefly described.

Figure 1:
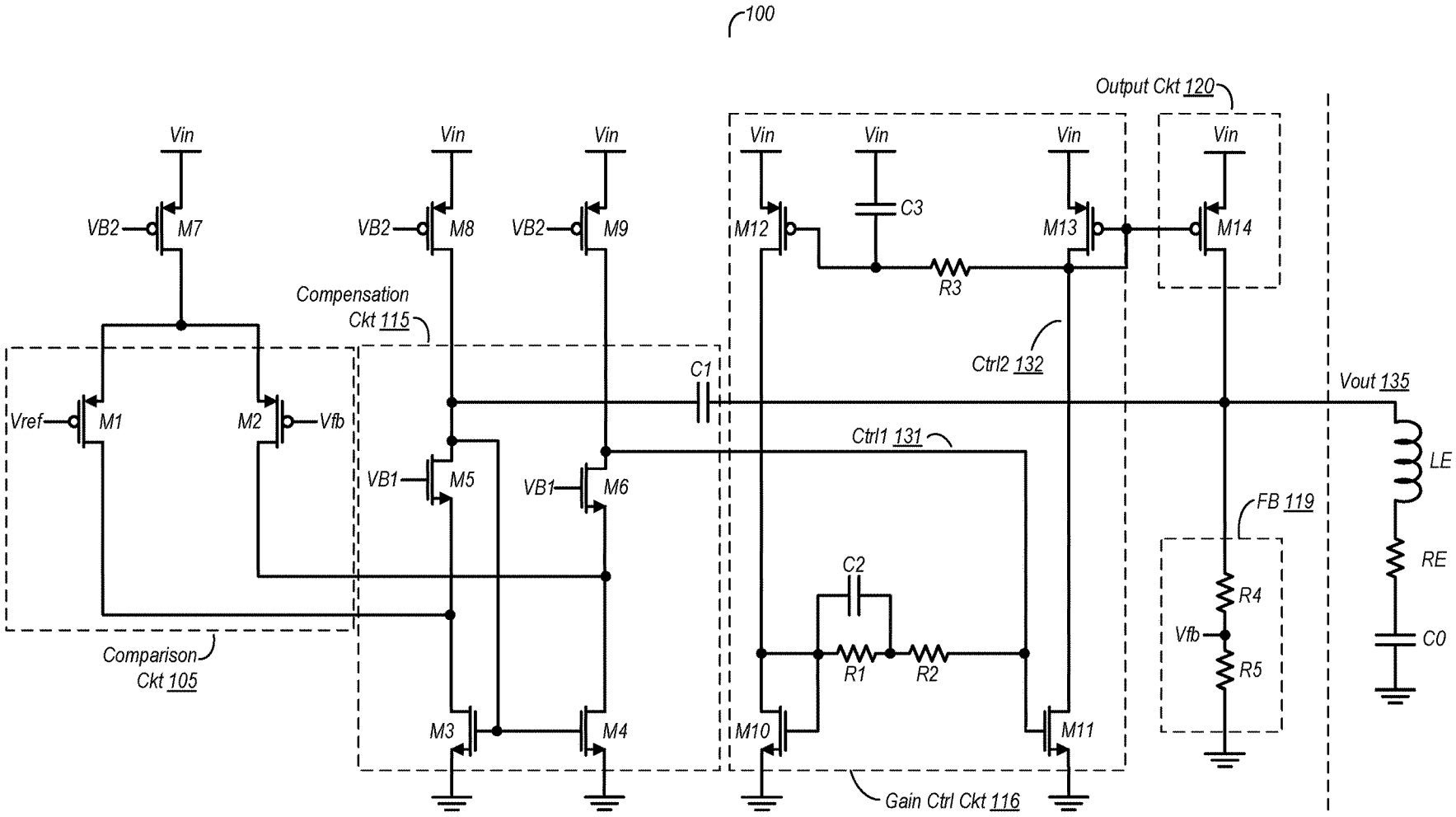
FIG. 1 is a schematic diagram of one embodiment of a voltage regulator circuit.

Although the embodiments disclosed herein are susceptible to various modifications and alternative forms, specific embodiments are shown by way of example in the drawings and are described herein in detail. It should be understood, however, that drawings and detailed description thereto are not intended to limit the scope of the claims to the particular forms disclosed. On the contrary, this application is intended to cover all modifications, equivalents and alternatives falling within the spirit and scope of the disclosure of the present application as defined by the appended claims.

This disclosure includes references to "one embodiment," "a particular embodiment," "some embodiments," "various embodiments," or "an embodiment." The appearances of the phrases "in one embodiment," "in a particular embodiment," "in some embodiments," "in various embodiments," or "in an embodiment" do not necessarily refer to the same embodiment. Particular features, structures, or characteristics may be combined in any suitable manner consistent with this disclosure.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical, such as an electronic circuit). More specifically, this formulation is used to indicate that this structure is arranged to perform the one or more tasks during operation. A structure can be said to be "configured to" perform some task even if the structure is not currently being operated. A "credit distribution circuit configured to distribute credits to a plurality of processor cores" is intended to cover, for example, an integrated circuit that has circuitry that performs this function during operation, even if the integrated circuit in question is not currently being used (e.g., a power supply is not connected to it). Thus, an entity described or recited as "configured to" perform some task refers to something physical, such as a device, circuit, memory storing program instructions executable to implement the task, etc. This phrase is not used herein to refer to something intangible.

The term "configured to" is not intended to mean "configurable to." An unprogrammed FPGA, for example, would not be considered to be "configured to" perform some specific function, although it may be "configurable to" perform that function after programming.

Reciting in the appended claims that a structure is "configured to" perform one or more tasks is expressly intended not to invoke 35 U.S.C. § 112(f) for that claim element. Accordingly, none of the claims in this application as filed are intended to be interpreted as having means-plus-function elements. Should Applicant wish to invoke Section 112(f) during prosecution, it will recite claim elements using the "means for" [performing a function] construct.

As used herein, the term "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

As used herein, the phrase "in response to" describes one or more factors that trigger an effect. This phrase does not foreclose the possibility that additional factors may affect or otherwise trigger the effect. That is, an effect may be solely in response to those factors, or may be in response to the specified factors as well as other, unspecified factors. Consider the phrase "perform A in response to B." This phrase specifies that B is a factor that triggers the performance of A. This phrase does not foreclose that performing A may also be in response to some other factor, such as C. This phrase is also intended to cover an embodiment in which A is performed solely in response to B.

As used herein, the terms "first," "second," etc. are used as labels for nouns that they precede, and do not imply any type of ordering (e.g., spatial, temporal, logical, etc.), unless stated otherwise. For example, in a register file having eight registers, the terms "first register" and "second register" can be used to refer to any two of the eight registers, and not, for example, just logical registers 0 and 1.

When used in the claims, the term "or" is used as an inclusive or and not as an exclusive or. For example, the phrase "at least one of x, y, or z" means any one of x, y, and z, as well as any combination thereof.

In the following description, numerous specific details are set forth to provide a thorough understanding of the disclosed embodiments. One having ordinary skill in the art, however, should recognize that aspects of disclosed embodiments might be practiced without these specific details. In some instances, well-known circuits, structures, signals, computer program instruction, and techniques have not been shown in detail to avoid obscuring the disclosed embodiments.

DETAILED DESCRIPTION OF EMBODIMENTS

The present disclosure is directed to a voltage regulator circuit that is designed for use in a wide variety of different environments. Many voltage regulators are implemented on an integrated circuit (IC), but provide power to other circuits that are off-chip, or provide power on-chip but requires compensation capacitors off-chip. Accordingly, the output power node of these voltage regulators may be connected to circuit traces of a printed circuit board (PCB) and various types of bonding thereto. With long on-chip/off-chip routing and sophisticated bonding/probing in certain systems, the low dropout (LDO) voltage regulator designs used in such systems may encounter a wide range of routing impedance. The wide range of output impedance that an LDO voltage regulator might be exposed to can make stabilization of such circuit more difficult. Conventional LDO stabilization approaches such as internal compensation or lowering the LDO gain may consume large area on an IC or sacrifice various aspects of the circuit's performance.

Due to the demand for better performance in various systems, an increasing number of functions and circuits are integrated into a single chip, and thus the chip sizes continue to increase. Recently, the chip size can grow up to a few centi-meters in some of the applications, which results a very large routing impedance at LDO output. On the other hand, to support an increased number of pins in such systems, the pitch of the pins is getting increasingly smaller, which makes the connections (i.e., bonding or ATE probing) between an on-chip LDO voltage regulator to an off-chip capacitor more difficult. These types of bonding can significantly increase the routing impedance between the LDO voltage regulator and the correspondingly coupled load circuit(s).

The LDO voltage regulator implements various techniques to overcome the problems discussed above, and is thus suited for use in a wide variety of operating environments. In various embodiments of the LDO voltage regulator of the present disclosure, output zero tracking compensation is implemented to stabilize the LDO for a wide range of ESR (equivalent series resistance) and ESL (equivalent series inductance) values of an external compensation capacitor. Furthermore, an AC resistor is introduced in some embodiments through a proportional current feedback path to improve the DC accuracy of the LDO. Pole/zero pair based compensation is incorporated in the design of some embodiments to further improve DC accuracy and transient performance without adversely affecting the stability. Such embodiments are now discussed in further detail below, beginning with FIG. 1.

FIG. 1 is a schematic diagram of one embodiment of a voltage regulator circuit. In the embodiment shown, voltage regulator 100 includes a number of different circuit units. These units include a comparison circuit 105, a compensation circuit 115, a gain control circuit 116, an output circuit 120, and a feedback circuit 119. Voltage regulator 100 is configured to generate and provide a regulated supply voltage. In the embodiment shown, voltage regulator 100 is an LDO voltage regulator coupled to receive an input voltage, Vin, and provide a regulated output voltage on an output node, Vout 135.

In the embodiment shown, comparison circuit 105 is configured to generate an error signal using a feedback signal and a reference voltage level. For this embodiment, the error signal is a differential signal provided from comparison circuit 105 to compensation circuit 115.

Comparison circuit 105 includes input transistors M1 and M2, both of which are PMOS transistors in this embodiment. A transistor M7 (also implemented as a PMOS) includes a source terminal coupled to an input voltage node (Vin) and a drain terminal coupled to respective source terminals of both M1 and M2. A current provided to both M1 and M2, through M7, is dependent at least in part on a bias voltage VB2 provided to the gate terminal of M7. The bias voltage VB2 may be generated by a bandgap circuit or any other suitable voltage generation circuit (omitted here for clarity). Transistor M1 includes a gate terminal coupled to receive a reference voltage, Vref, which may be also be generated by a bandgap circuit or other suitable voltage generation circuit. Transistor M2 includes a gate terminal that is coupled to receive a feedback voltage, Vfb, which is generated by feedback circuit 119. In this particular embodiment, feedback circuit 119 is implemented using a resistive voltage divider including resistors R4 and R5. The feedback voltage taken from the junction of these two resistors. The other terminals of R4 is coupled to the output voltage node, Vout, while the other terminal of R5 is coupled to a ground node. Comparison circuit 105 performs a comparison of the reference voltage, Vref, and the feedback voltage, Vfb, and provides a corresponding differential error signal to compensation circuit 115.

Compensation circuit 115 converts the differential error current signals provided by the comparison circuit 105 to a control voltage signal. Furthermore, compensation circuit 115 implements output zero tracking and compensation, as will be further discussed below. As shown in FIG. 1, compensation circuit 115 includes transistors M3 and M4, which are NMOS transistors in this implementation. A drain terminal of M3 is coupled to a drain terminal of M1 of comparison circuit 105. Similarly, a drain terminal of M4 is coupled to a drain terminal of M2, also in comparison circuit 105. Accordingly, the differential error voltage generated by comparison circuit 105 is provided to the drain terminals of M3 and M4.

Transistors M3 and M4 of compensation circuit 115 form a current mirror. Transistor M3 is diode coupled, across transistor M5. The drain terminal of M3 is coupled to a source terminal of M5, while the drain terminal of transistor M4 is coupled to the source terminal of M6. Both transistors M5 and M6 (implemented here as NMOS transistors) include gate terminals coupled to receive a reference voltage VB1, which may be generated by a bandgap circuit or other suitable voltage generation circuit. The current through the current mirror may be in part based on the current through transistors M5 and M6.

Drain terminals of transistor M5 and M6 are coupled to corresponding drain terminals of PMOS bias transistors M8 and M9, respectively. Source terminals of M8 and M9 are coupled to the input voltage node, Vin. Respective gate terminals of M8 and M9 are coupled to receive the reference voltage VB2. Accordingly, the current through the transistors of the current mirror is also partly dependent on the current through transistors M8 and M9, and thus the bias voltage VB2.

Compensation circuit 115 in the embodiment shown is capacitively coupled to the output voltage node, Vout 135, via capacitor C1. Transistors M3 and M4, along with capacitor C1, implement the output zero tracking compensation function, where a compensation pole is introduced into the transfer function of voltage regulator 100 to track the output parasitic zero caused by the routing impedance from the voltage regulator output Vout to load capacitor C0. The location of this compensation pole may vary with a zero in the transfer function that is dependent on the ESR or ESL of the impedance between a load circuit and the output voltage node, as will be discussed in further detail below.

Gain control circuit 116 in the embodiment shown is coupled to receive a control signal, via control signal node 131, from compensation circuit 115. A modified control signal is generated by gain control circuit 116 and provided on a second control signal node 132. In the embodiment shown, gain control circuit 116 implements functions directed to gain control and bandwidth control using what is referred to here as an "AC resistor" technique, which will be discussed below.

In the embodiment shown, gain control circuit includes NMOS transistor M10 and M11, each of which includes a source terminal coupled to a ground node. Gain control circuit 116 is a diode coupled device in the embodiment shown. The drain and source terminals of M10 are couple to one terminal of a resistor R1, which is couple in series with another resistor, R2. The other terminal of R2 is coupled to the gate terminal of M11, and thus to the control signal node 131. A capacitor C2 is coupled in parallel with resistor R1. The combination of resistors R1 and R2, along with capacitor C2 in the embodiment shown implement a pole/zero compensation technique, which is also discussed in further detail below.

Gain control circuit 116 also includes PMOS transistors M12 and M13, which have corresponding drain terminals coupled to drain terminals of M10 and M11, respectively. Source terminals of M12 and M13 are coupled to the input voltage node. The node coupling the drain terminals of M11 and M13 is the second control signal node 132, which is also coupled to the gate terminal of M13. A resistor R3 is coupled between the second control signal node 132 and the gate terminal of M12. A capacitor C3 is coupled between the gate terminal of M12 and the input voltage node, Vin.

Output circuit 120 in the embodiment shown includes PMOS transistor M14. The source of transistor of M14 is coupled to the input voltage node, Vin, while the drain terminal of this device is coupled to the output voltage node, Vout 135 (and thus implements a common drain configuration). The gate terminal of M14 is coupled to the second control signal node 132, and thus is coupled to receive the modified control signal output generated by gain control circuit 116. The output voltage node 135 in the illustrated embodiment is coupled to an example output impedance represented by inductor LE, resistor RE, and capacitor C0, which are coupled in series with one another.

Figure 2:
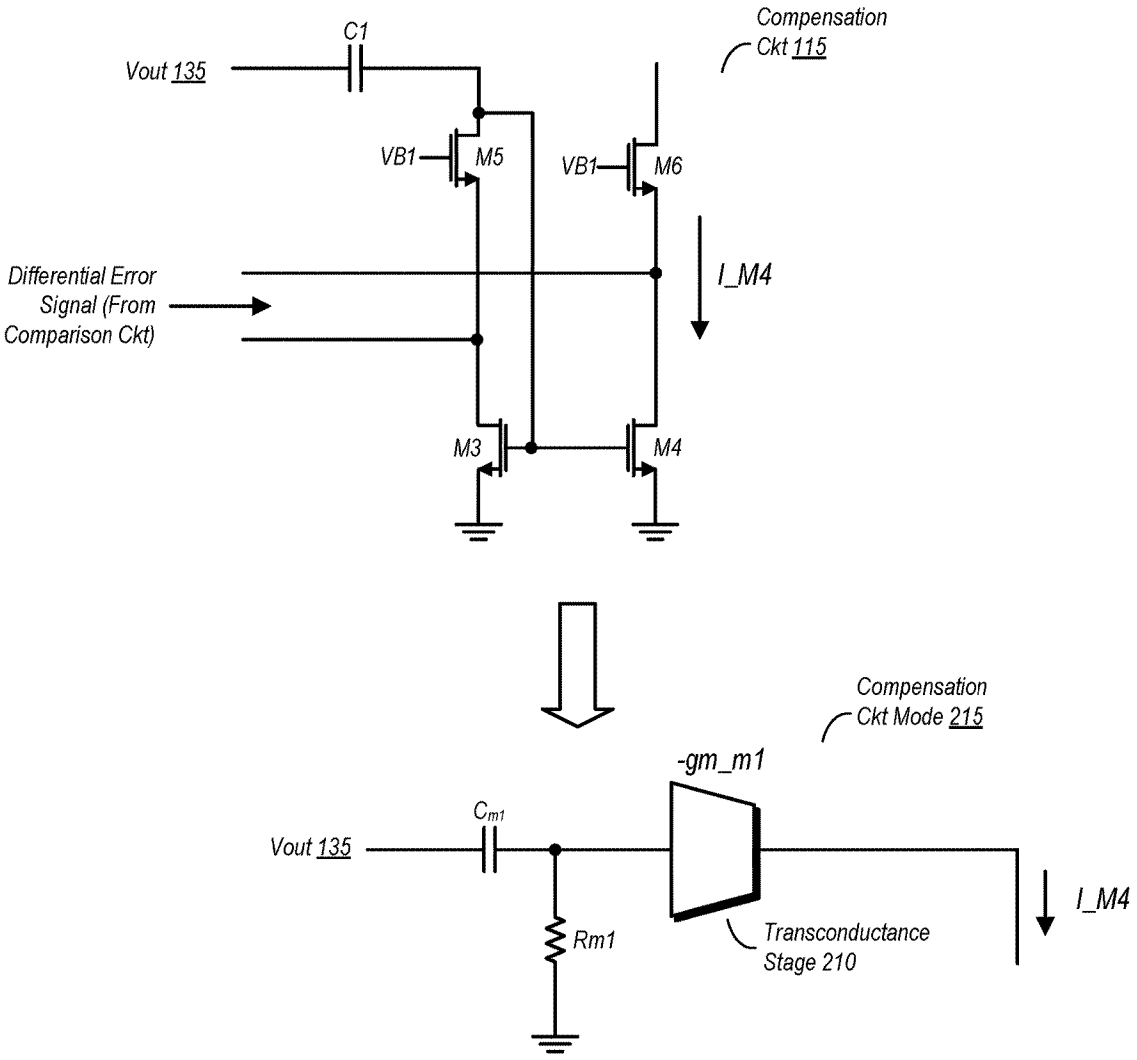
FIG. 2 is a model representative of one embodiment of a compensation circuit used in a voltage regulator.

FIG. 2 illustrates a model representative of one embodiment of a compensation circuit used in a voltage regulator. More particularly, FIG. 2 illustrates the compensation circuit 115 as implemented, and the corresponding compensation circuit model 215. As discussed above, compensation circuit 115 includes transistor M3, M4, M5, and M6, along with capacitor C1, which provides a feedback path from the output voltage node 135. The differential error signal is also received on the drain terminals of M3 and M4, from the comparison circuit 105.

Compensation circuit model 215 includes capacitor $C_{m1}$, which corresponds to capacitor C1 of FIG. 1. The diode connected transistor M3 is modeled as resistor Rm1. Meanwhile, transistor M4 is modeled as transconductance stage 210, which has a transconductance −gm_m1. The transconductance stage 210 generates the current I_M4 (equivalent to the current through M4 in the actual circuit) that provides the basis for the (unmodified) control signal.

Figure 3:
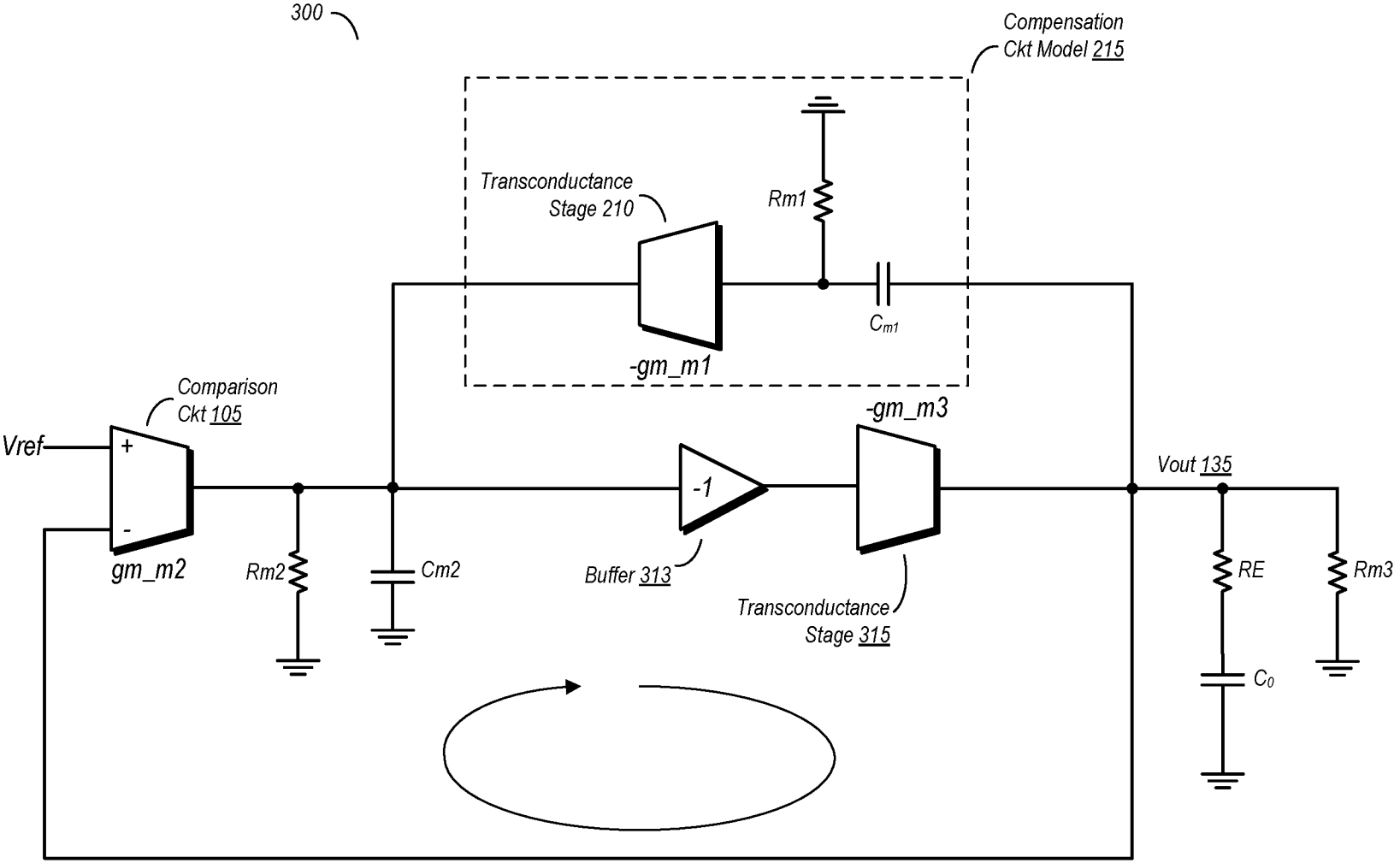
FIG. 3 is a model of one embodiment of a voltage regulator.

FIG. 3 is a model of one embodiment of a voltage regulator. Model 300 as shown here includes the compensation circuit model 215, and also includes representation of other portion of voltage regulator 100 of FIG. 1. Model 300 is a simplified LDO voltage regulator model of the circuit shown in FIG. 1 and which implements an output zero tracking compensation scheme. The model includes comparison circuit 105, which, in this case, receives the feedback voltage from Vout node 135 directly on the inverting input (Vref is received on the non-inverting input). Comparison circuit 105 is modeled here as a transconductance stage having a transconductance of gm_m2 (equivalent transconductance of comparison circuit 105), and also includes Rm2 and Cm2 (equivalent output resistance and output capacitance, respectively, of compensation circuit 115). A buffer 313 is modeled as an amplifier stage having a gain of −1, and another transconductance stage 315 is also shown, along with resistor Rm3. The buffer 313 shown in FIG. 3 is formed by transistors M13 of FIG. 1. Transconductance stage 315 models the transconductance of output circuit 120, while resistor Rm3 models the equivalent load of LDO voltage regulator 100. For simplicity, the output routing impedance is modeled as RE here. However, the functioning of the model, and thus the circuit, may be in accordance with an implementation coupled to a more complicated RLC model of the output impedance.

The loop transfer function L(s) for LDO voltage regulator 100 of FIG. 1, and model 300 of FIG. 3, can be expressed as:

$$\frac{g_{m_m1}g_{m_m3}R_{m2}R_{m3}(1+R_{m1}C_{m1}s)(1+R_EC_os)}{1+(R_{m2}C_{m2}+R_{m3}C_o+g_{m_m1}g_{m_m3}R_{m1}R_{m2}R_{m3}C_{m1})s+(R_{m2}R_{m3}C_{m2}C_O+g_{m_m1}g_{m_m3}R_{m1}R_{m3}R_EC_{m1}C_o)s^2+R_{m1}R_{m2}R_{m3}C_{m1}C_{m2}C_os^3}. \quad (1)$$

The compensation capacitor $C_{m1}$ from model 300, and in the expression above, can be sized in the range of:

$$\frac{C_{m2}}{g_{m_m3}\times R_E}<C_{m1}<\frac{C_0}{g_{m_m3}\times R_{m2}}. \quad (2)$$

Based on (1) and (2) above, poles $p_1$, $p_2$, and $p_3$ can be derived as follows:

$$p_1\cong\frac{1}{R_{m3}C_o} \quad (3)$$

$$p_2\cong\frac{1}{R_{m2}C_{m2}+g_{m_m1}g_{m_m3}R_{m2}R_{m1}R_EC_{m1}} \quad (4)$$

$$p_3\cong\left(1+\frac{g_{m_m1}g_{m_m3}R_{m1}R_EC_{m1}}{C_1}\right)\frac{1}{R_{m1}C_{m1}}. \quad (5)$$

The ESR zero $z_1$ and the second zero $z_2$ can be derived as:

$$z_1\cong\frac{1}{R_EC_o} \quad (6)$$

$$z_2\cong\frac{1}{R_{m1}C_{m1}}. \quad (7)$$

Figure 4:
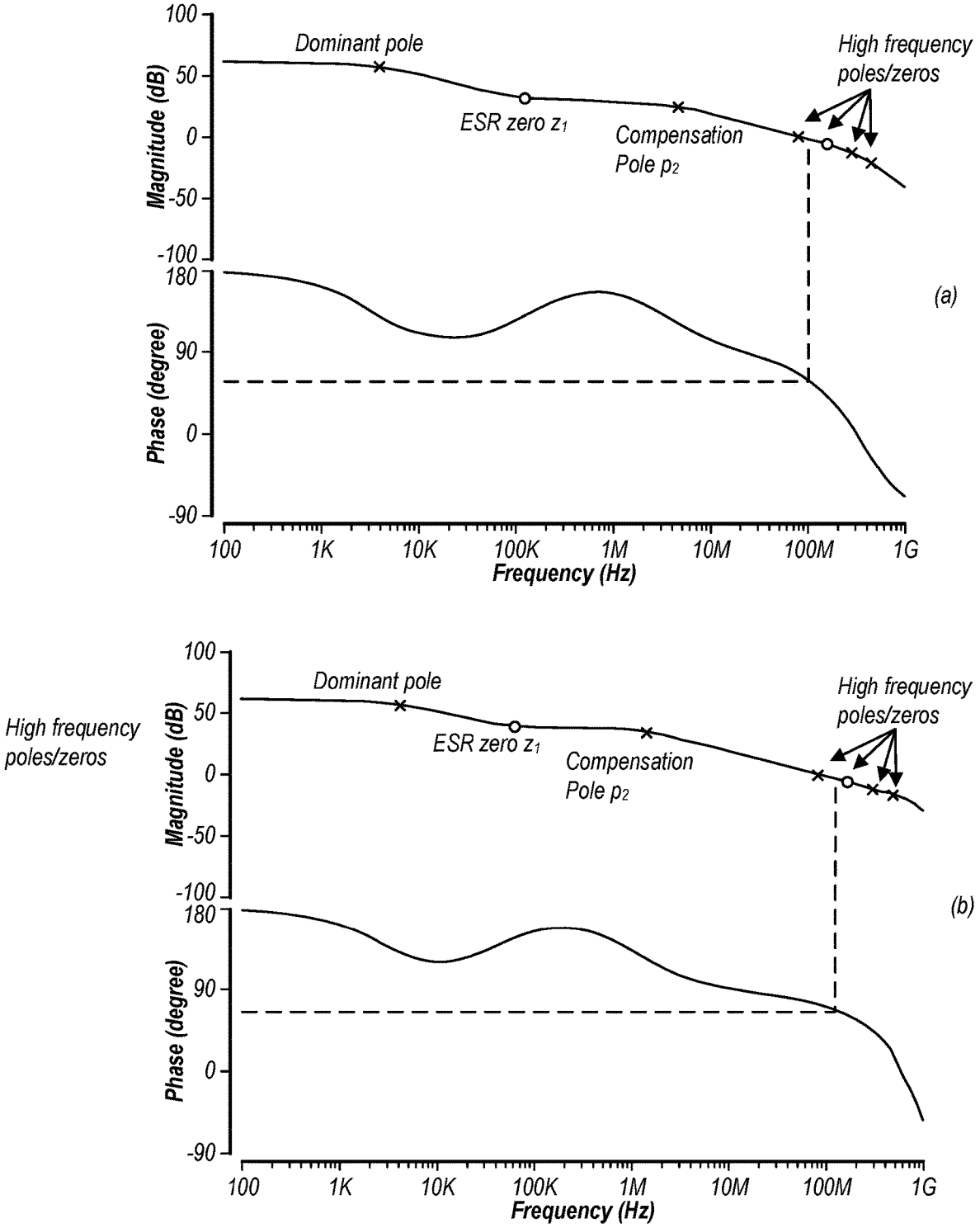
FIG. 4 is a graphic illustration of compensation zero tracking scheme implemented by one embodiment of a voltage regulator.

In observing Equation 4 and Equation 6, it can be seen that the pole $p_2$ always tracks the ESR zero $z_1$ when the routing impedance RE changes. This is graphically illustrated in FIG. 4. In graph (b), the frequency of the ESR zero $z_1$, at a frequency less than 100 kHz, is less than that as shown in graph (a), where it appears at a frequency greater than 100 kHz. Similarly, the frequency of the compensation pole $p_2$ is less in graph (b), at a frequency of around 2 MHz, than in graph (a), where it occurs at about 8 MHz. The difference in the location of the poles and zeros in graphs (a) and (b) is due to the different routing impedances, represented by the variable $R_E$. This variable appears in the denominator of the transfer function for both of the ESR zero $z_1$, and the compensation pole $p_2$. Thus, an increase of the routing impedance and ESR $R_E$ therefore reduces the frequency of both ESR zero $z_1$, and compensation pole $p_2$. Similarly, as the routing impedance $R_E$ gets smaller, the frequency of both ESR zero $z_1$, and compensation pole $p_2$ increases. Thus, the compensation pole $p_2$ "tracks" the both ESR zero $z_1$ with changes in the routing impedance.

As a result of the compensation described above, which is produced by compensation circuit 115 of FIG. 1, high stability margins may be achieved over a wide range of output impedances. In the absence of the compensation pole, the stability margin for LDO voltage regulator 100 is smaller, as the high frequency poles will occur much closer to the unity gain frequency.

Figure 5:
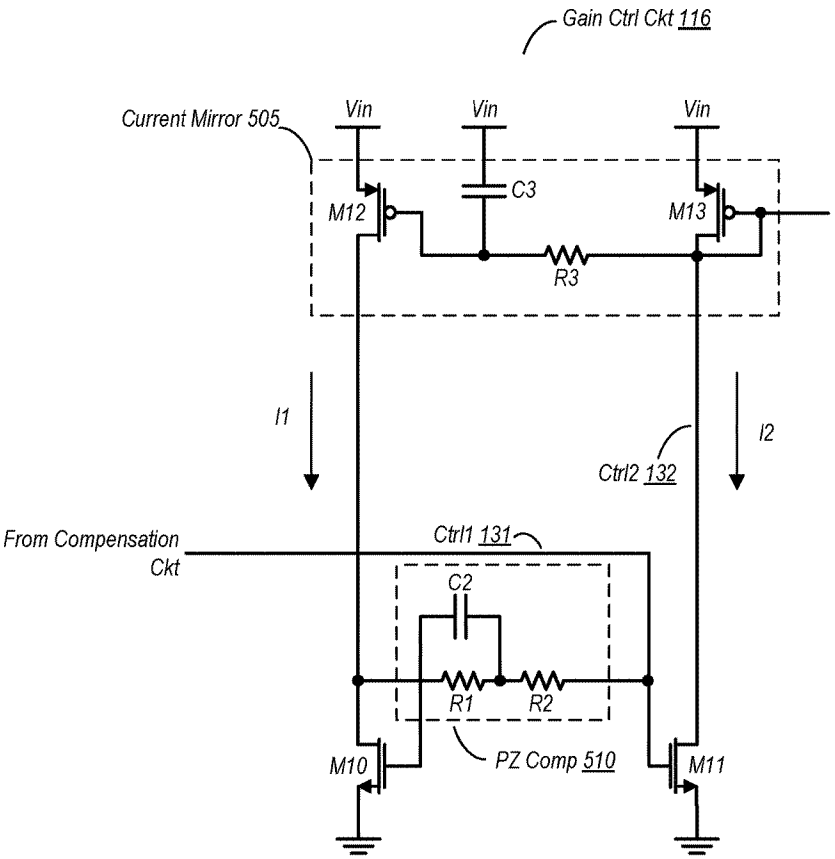
FIG. 5 is an annotated schematic diagram of one embodiment of a gain/bandwidth control circuit implemented in an embodiment of a voltage regulator.

FIG. 5 is an annotated schematic diagram of one embodiment of a gain/bandwidth control circuit implemented in an embodiment of a voltage regulator. In the embodiment shown, gain control circuit 116 includes the same components as that of FIG. 1. As shown here, a portion of gain control circuit 115 comprises a current mirror 505, while another portion comprises a pole-zero compensation circuit 510. The current mirror 505 along with transistor M10 forms a local feedback that ensure the steady state current density through transistor M10 and M11 to be the same regardless of the voltage on control signal node 131. The steady state voltage across the resistor R1 and R2 is nearly 0V, and there is no DC current flowing through these resistors. The high frequency gain of the local feedback circuit formed by current mirror 505 and M10 are attenuated by low-pass filter R3 and C3, the resistor R1 and R2 can conduct AC but not the DC current, thus such topology is referred as an AC resistor.

Control of the bandwidth of an LDO voltage regulator is used to ensure its stability. In the embodiment shown, bandwidth control may be achieved by the gain control resistors R1 and R2, the latter of which has one terminal coupled to control signal node 131, via which the first control signal is received from compensation circuit 105. However, if DC current is flowing through resistors R1 and R2, the DC accuracy of LDO voltage regulator 100 may be seriously degraded. Thus, as described above, resistors R1 and R2 are arranged such that, while AC current can be conducted, no DC current passes through these devices.

The AC resistor technique is implemented in the embodiment shown using transistors M10 through M13, resistor R1 through R3 and capacitor C3. Transistors M12 and M13 form a current mirror pair in current mirror 505 that ensures the current densities through transistor M10 and M11 are substantially the same. When the current densities through M10 and M11 are the same, the voltage across the resistors R1 and R2 will remain the same (with no current through these components). Thus, even as load current varies, the constant current densities through M10 and M11 thus ensures that the voltage across the series coupling of R1 and R2 is nearly zero.

Resistor R3 and capacitor C3 are employed in the illustrated embodiment to reduce the corner frequency of the AC resistor and eliminates local positive feedback. Thus, the impact of the "AC resistor" on loop stability is minimized. Using the AC resistor technique, the DC accuracy of the LDO voltage regulator 100 may be significantly improved, while its bandwidth may be well controlled.

Pole-zero compensation circuit 510 also implements a pole-zero compensation technique. This technique may improve the DC and transient performance of LDO voltage regulator 100 without adversely affecting stability of the circuit. When placed in parallel with resistor R1, capacitor C2 implements a lower frequency pole and a higher frequency zero. The ratio of resistor R1 and R2 may, in one embodiment, be in a range of one to five, with the corresponding ratio between the lower frequency pole and the higher frequency zero being between two and six. This may help LDO voltage regulator 100 to avoid excessive phase dip which, left unchecked, and have an adverse effect on transient and stability performance.

Figure 6:
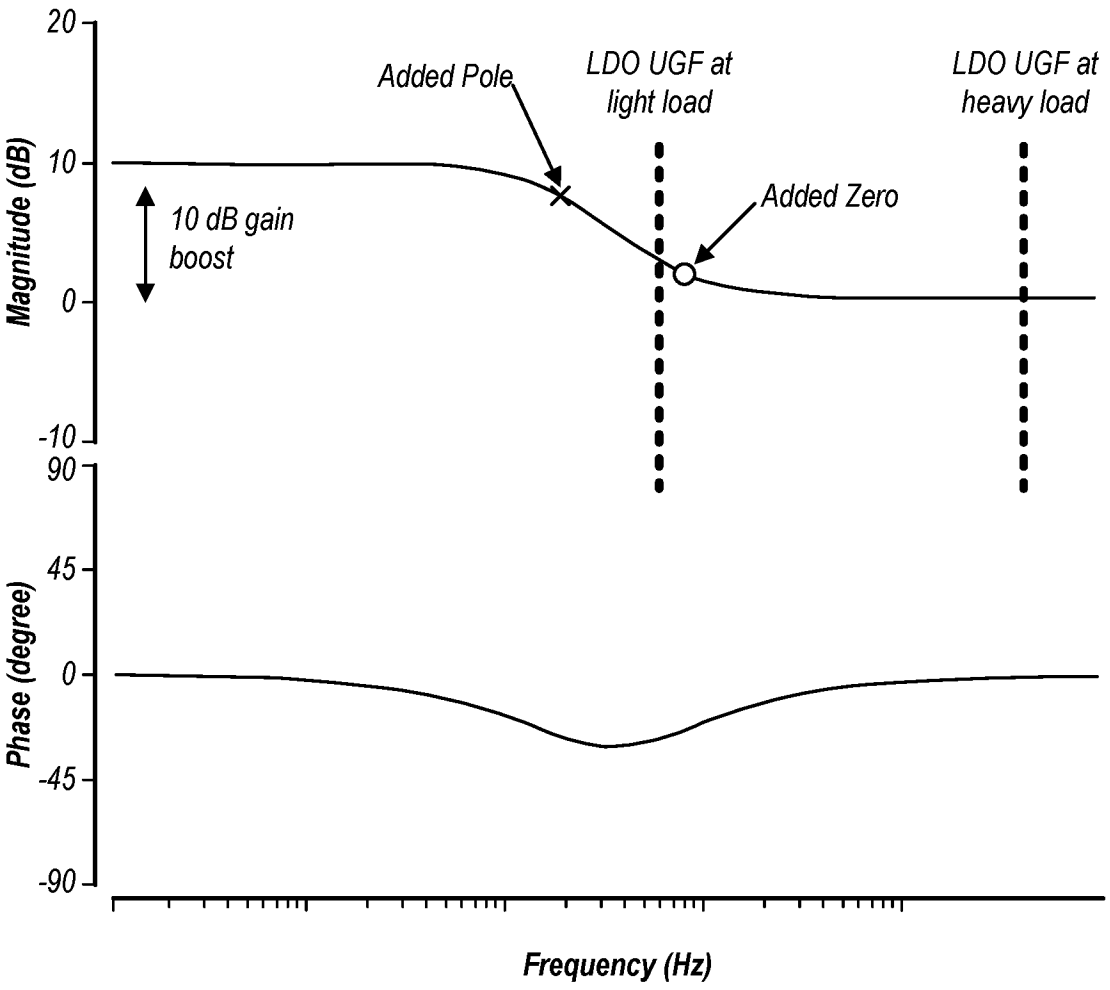
FIG. 6 is a graphic illustration of pole/zero compensation technique implemented by one embodiment of a voltage regulator circuit.

The frequency response in relation to the low frequency pole and high frequency zero introduced by pole-zero compensation circuit is graphically illustrated in FIG. 6. As shown in FIG. 6, the added pole occurs at a frequency that is less than the light-load unity gain frequency (UGF), while the added zero occurs at a frequency that is greater than the light load UGF. This may minimize the phase dip in the lower portion of the graph. The compensation thus allows for greater DC/AC gain below the frequency of the added pole without any significant phase margin degradation, irrespective of the UGF of the loop transfer function of LDO voltage regulator 100. Furthermore, the pole/zero pair-based compensation implemented by pole-zero circuit 510, the gain of LDO voltage regulator 100, and thus its DC and transient performance may be improved while maintaining high stability margin.

Figure 7:
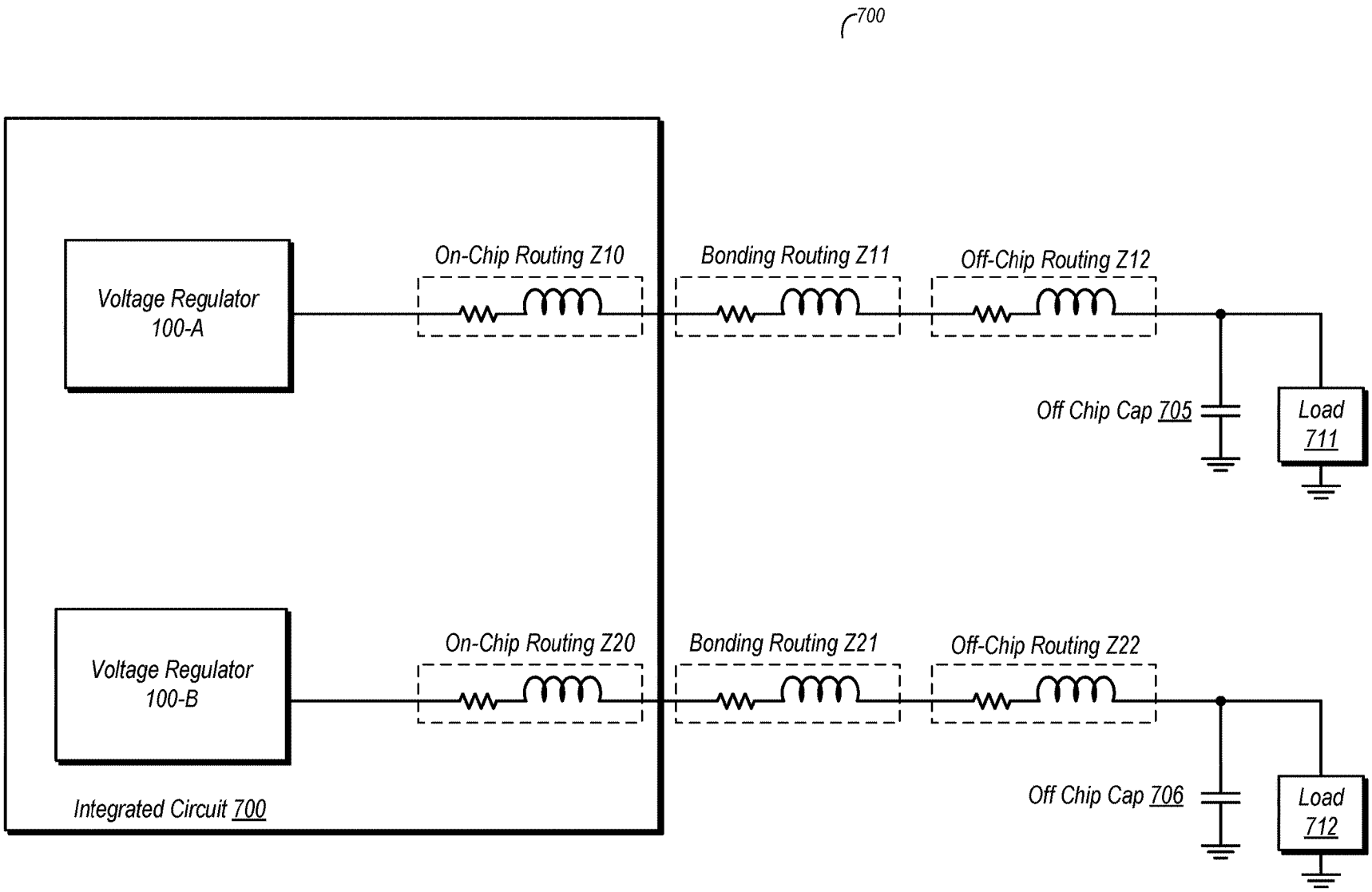
FIG. 7 is a block diagram of one embodiment of a system having multiple instances of one embodiment of a voltage regulator coupled to different routing impedances.

FIG. 7 is a block diagram of one embodiment of a system having multiple instances of one embodiment of a voltage regulator coupled to different routing impedances. In the embodiment shown, IC 700 includes two voltage regulators, voltage regulator 100-A and voltage regulator 100-B. These voltage regulators may be an embodiment implemented in accordance with that of FIGS. 1-6 as discussed above, and may thus be LDO voltage regulators. Accordingly, in an embodiment of FIG. 7, IC 700 voltage regulators 100-A and 100-B may be substantially identical.

Voltage regulator 100-A in the embodiment shown is couple to provide a regulated supply voltage to a first load circuit 711, that is implemented off chip (e.g., that is not on the same IC die as IC 700). The impedance encountered by voltage regulator 100-A includes on-chip routing Z10, bonding routing Z11, and off-chip routing Z12. The on-chip routing Z10 may include impedances from circuit connections/wires within IC 700 and the packaging thereof that coupled voltage regulator 100-A to pins provided for interfacing to the external world. Bonding routing Z11 may include impedances from structures that done the packing of IC 700 to, e.g., a printed circuit board. This may include, for example, a solder ball of a ball-grid array. The off-chip routing Z12 may include impedances from, e.g., circuit traces on a printed circuit board, as well as any structures that connect load circuit 711 thereto. An off-chip capacitor 705 is also provided, coupled in parallel with load circuit 711 in this particular embodiment.

Voltage regulator 100-B is coupled to load circuit 712 via on-chip routing Z20, bonding routing Z21, and off-chip routing Z22. An off-chip capacitor 706 is also coupled in parallel with load circuit 712. The values of impedances provided by on-chip routing Z20, bonding routing Z21, and off-chip routing Z22 may be different than those of on-chip routing Z10, bonding routing Z11, and off-chip routing Z12. Despite these differences, as mentioned above, voltage regulator 100-A and 100-B may be substantially the same, and designed in accordance with the principles discussed above in reference to FIGS. 1-6. Since the voltage regulator of the present disclosure is designed to operate with a wide variety of different impedances between its output and the load circuit, the different impedances between the two instances shown here may have little if any adverse effect on their operation. The ability to operate in a wide variety of environments provides a significant amount of flexibility in the design of the PCB upon which a chip including the voltage regulator is implemented. The flexibility also allows for smaller-pitch connecting pins on an IC that includes the voltage regulator.

In addition to the above, the flexibility, various embodiments of LDO voltage regulator 100 as disclosed herein may operate with improved transient response and DC accuracy, which may allow operation with a smaller off-chip capacitor or smaller operating current. Since the design of LDO voltage regulator does not rely on Miller compensation as some voltage regulators do, greater power supply rejection ratio (PSRR) may be achieved. Since the design of various embodiments of LDO voltage can be used in many different environments, system design and engineering time may be saved, since voltage regulator may need no significant adjustments, if any, for the environment of the system in which it is to be used.

Figure 8:
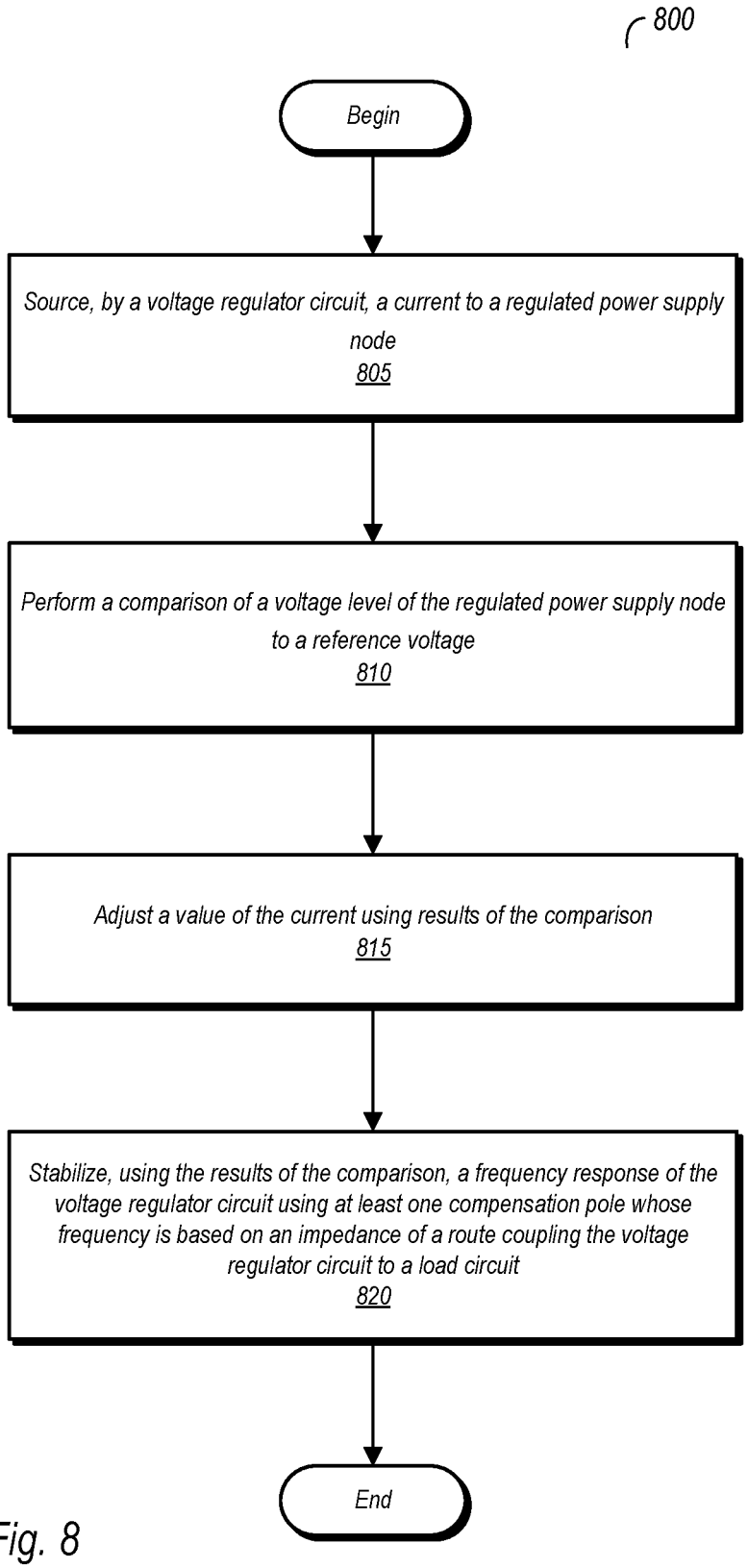
FIG. 8 is a flow diagram illustrating one embodiment of a method for operating a voltage regulator.

FIG. 8 is a flow diagram illustrating one embodiment of a method for operating a voltage regulator. Method 800 as discussed herein may be implemented using various embodiments of the circuitry discussed above with reference to FIGS. 1-7. Other circuit embodiments that are not explicitly disclosed herein but are otherwise capable of carrying out Method 800 may fall within the scope of this disclosure.

Method 800 includes sourcing, by a voltage regulator circuit, a current to a regulated power supply node (block 805). The method further includes performing a comparison of a voltage level of the regulated power supply node to a reference voltage (block 810), and adjusting a value of the current using results of the comparison (block 815). Method 800 also includes stabilizing, using the results of the comparison, a frequency response of the voltage regulator circuit using at least one compensation pole whose frequency is based on an impedance of a route coupling the voltage regulator circuit to a load circuit (block 820).

In various embodiments, the stabilizing a frequency response of the voltage regulator circuit further comprises using at least one compensation zero having a frequency that is dependent on the frequency of the compensation pole, wherein a frequency of the compensation zero is less than the frequency of the compensation pole (the compensation zero and the compensation pole being part of the circuit's transfer function).

In some embodiments of the method, stabilizing the frequency response of the voltage regulator circuit includes a compensation circuit generating a first control signal based on the comparison and further comprises providing the first control signal to a gain control circuit. Based on the first control signal and using the gain control circuit, the method further includes generating a second control signal. Based on the second control signal, the method includes sourcing the current to the regulated voltage supply node. Also using the gain control circuit, the method includes adjusting a voltage-to-current gain based on the first control signal.

Various embodiments of the method also include controlling a bandwidth of the voltage regulator circuit by biasing voltages across first and second resistors of the gain control circuit to values independent of the current to the regulated power supply node. These embodiments of the method may also include controlling a frequency response of the gain control circuit using a pole-zero pain whose respective frequencies are based on the first resistor and a capacitor coupled across the first resistor.

Figure 9:
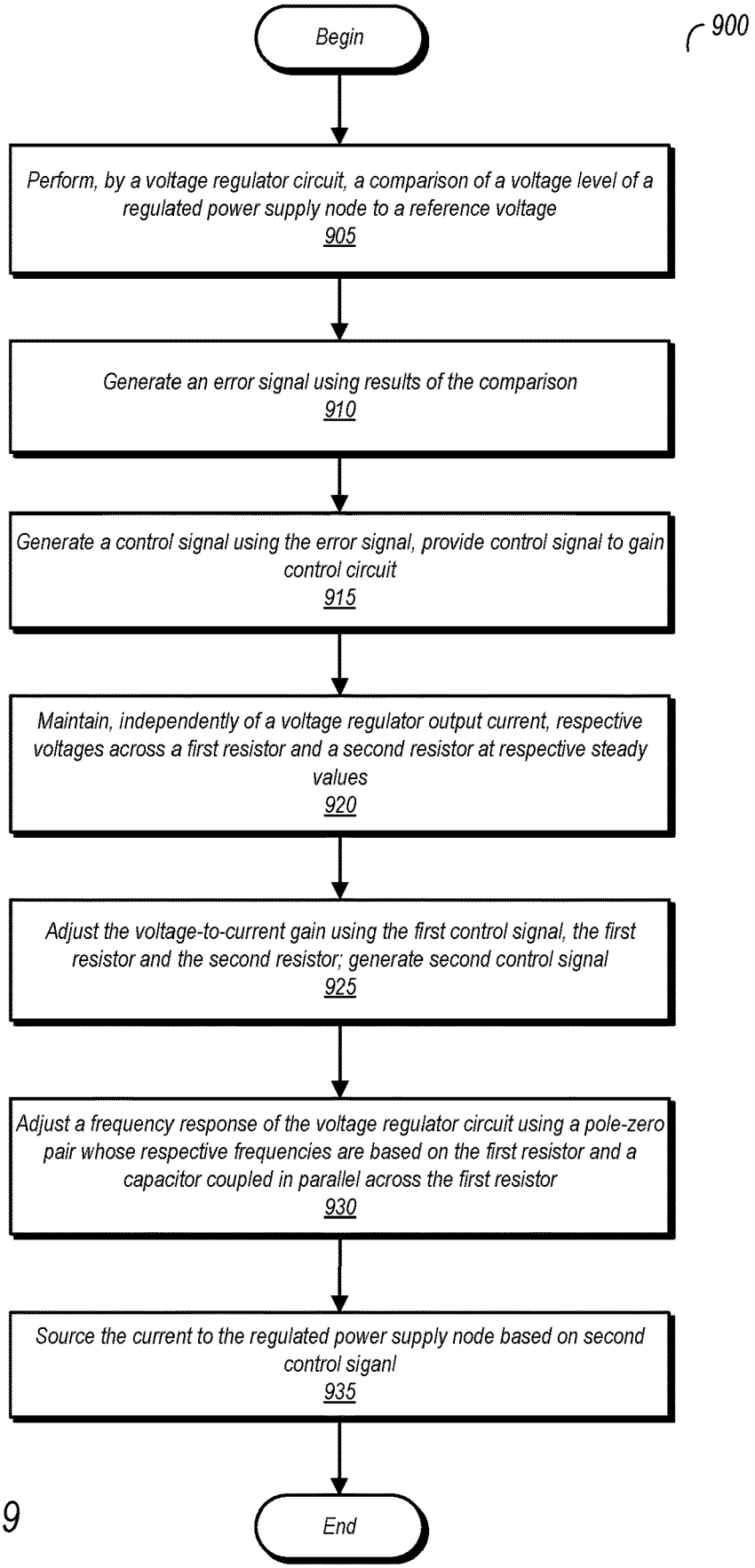
FIG. 9 is a flow diagram illustrating another embodiment of a method for operating a voltage regulator.

FIG. 9 is a flow diagram illustrating another embodiment of a method for operating a voltage regulator. Method 900 may be performed with various embodiments of the voltage regulator discussed above in reference to FIGS. 1-7. Embodiments of a voltage regulator not explicitly discussed herein but capable of carrying out Method 900 may also fall within the scope of this disclosure.

Method 900 includes performing, by a voltage regulator circuit, a comparison of a voltage level of a regulated power supply node to a reference voltage (block 905). Using results of the comparison, the method further includes generating an error signal (block 910). A control signal generated, by a compensation circuit, using the error signal and the method further includes providing the control signal to a gain control circuit (block 915). The gain control circuit may implement a portion of the method that includes maintaining, independently of an output current provided by the voltage regulator, respective voltages across a first resistor and a second resistor at respective steady values (block 920). The method also includes adjusting the voltage-to-current gain using the first control signal, the first resistor and the second resistor (block 925). Operating the gain control circuit includes adjusting a frequency response of the voltage regulator circuit using a pole-zero pair whose respective frequencies are based on the first resistor and a capacitor coupled in parallel across the first resistor (block 930). The gain control circuit generates a second control signal that is provided to an output circuit, with the method further including sourcing current to the regulated power supply node (block 935) based on the second control signal.

In various embodiments, the control signal provided to the gain control circuit is generated by the compensation circuit. The method includes the compensation circuit receiving the error signal and modifying the error signal to generate the control signal. The compensation circuit is capacitively coupled to the regulated powers supply node, and thus receives feedback via this path. Accordingly, modifying the error signal to generate the control signal is based on the voltage and current on the regulated power supply node.

Figure 10:
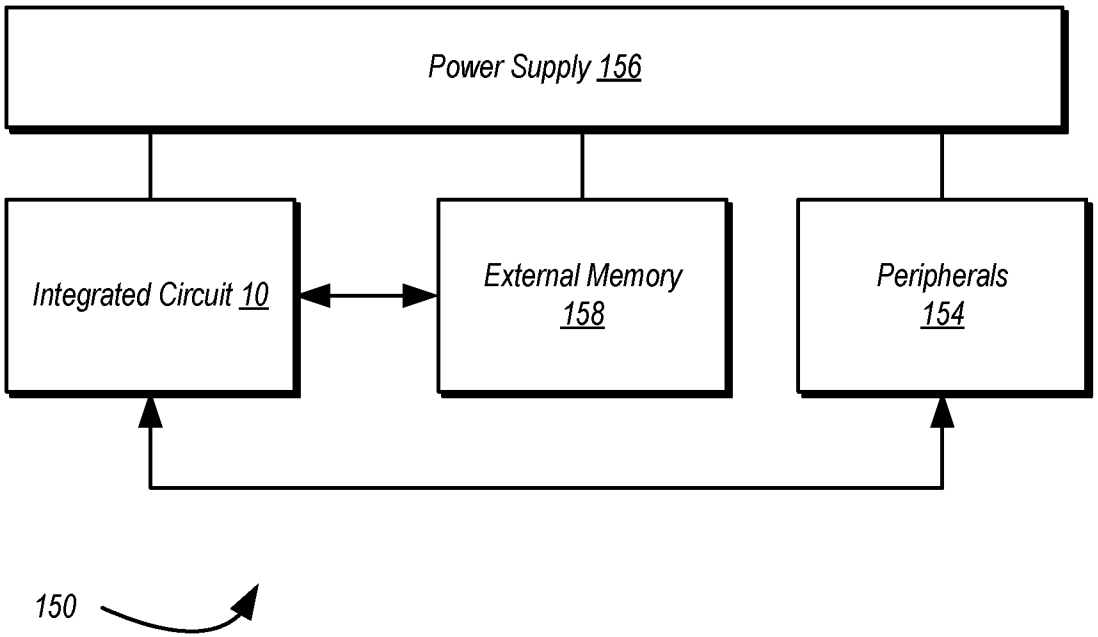
FIG. 10 is a block diagram of one embodiment of an example system.

Turning next to FIG. 10, a block diagram of one embodiment of a system 150 is shown. In the illustrated embodiment, the system 150 includes at least one instance of an integrated circuit 10 coupled to external memory 158. The integrated circuit 10 may include a memory controller that is coupled to the external memory 158. The integrated circuit 10 is coupled to one or more peripherals 154 and the external memory 158. A power supply 156 is also provided which supplies the supply voltages to the integrated circuit 10 as well as one or more supply voltages to the memory 158 and/or the peripherals 154. In some embodiments, more than one instance of the integrated circuit 10 may be included (and more than one external memory 158 may be included as well).

The peripherals 154 may include any desired circuitry, depending on the type of system 150. For example, in one embodiment, the system 150 may be a mobile device (e.g. personal digital assistant (PDA), smart phone, etc.) and the peripherals 154 may include devices for various types of wireless communication, such as WiFi, Bluetooth, cellular, global positioning system, etc. The peripherals 154 may also include additional storage, including RAM storage, solid-state storage, or disk storage. The peripherals 154 may include user interface devices such as a display screen, including touch display screens or multitouch display screens, keyboard or other input devices, microphones, speakers, etc. In other embodiments, the system 150 may be any type of computing system (e.g. desktop personal computer, laptop, workstation, tablet, etc.).

The external memory 158 may include any type of memory. For example, the external memory 158 may be SRAM, dynamic RAM (DRAM) such as synchronous DRAM (SDRAM), double data rate (DDR, DDR2, DDR3, LPDDR1, LPDDR2, etc.) SDRAM, RAMBUS DRAM, etc. The external memory 158 may include one or more memory modules to which the memory devices are mounted, such as single inline memory modules (SIMMs), dual inline memory modules (DIMMs), etc.

In various embodiments of system 150, IC 10 and/or an IC that is part of peripherals 154 may include one or more instances of a voltage regulator circuit as discussed above. This may include an instance of a voltage regulator circuit being coupled to provide a regulated supply voltage to a load circuit off chip, and may further be coupled to an off-chip capacitor.

Structures such as those shown with reference to various ones of the figures discussed above for implementation of a voltage regulator may be referred to using functional language. In some embodiments, these structures may be described as including "a means for generating a feedback signal," "a means for generating an error signal," "a means for generating a control signal," "a means for sourcing a current to a regulated supply voltage node," and so on.

The corresponding structure for "a means for generating a feedback signal" may be, e.g., feedback circuit 119 of FIG. 1, and corresponding equivalents. The corresponding structure for "a means for generating an error signal" may be, e.g., comparison circuit 105 of FIG. 1, and corresponding equivalents. The corresponding structures for "a means for generating a control signal" may include compensation circuit 115 and/or gain control circuit 116 of FIG. 1, and corresponding equivalents. The corresponding structures for "a means for sourcing a current to a regulated supply voltage node" may include output circuit 120 of FIG. 1, and corresponding equivalents. Where other functionality is discussed above in relation to particular structures (e.g., implementing pole/zero compensation), corresponding structures may also be referred to using functional language.

Numerous variations and modifications will become apparent to those skilled in the art once the above disclosure is fully appreciated. It is intended that the following claims be interpreted to embrace all such variations and modifications.

What is claimed is:

1. A circuit comprising:

a feedback circuit configured to generate a feedback signal using a voltage level of a regulated power supply node;

a comparison circuit configured to generate an error signal using the feedback signal and a reference voltage level;

a compensation circuit configured to modify, based on an impedance of a route coupled between the regulated power supply node and a load circuit, the error signal to generate a control signal;

an output circuit configured to source, based on the control signal, a current to the regulated power supply node; and a gain control circuit coupled to the compensation circuit and the output circuit, wherein the gain control circuit configured to generate, based on the control signal, a modified control signal, wherein the output circuit is configured to change the current to the regulated power supply node based on changes to the modified control signal, wherein the gain control circuit includes a first resistor and a capacitor coupled in parallel with the first resistor, and wherein a frequency response of the gain control circuit is dependent on a pole-zero pair whose respective frequencies are based on the first resistor and the capacitor.

2. The circuit of claim 1, wherein the compensation circuit includes a current mirror and a capacitor coupled between the current mirror and the regulated supply voltage node.

3. The circuit of claim 2, wherein the compensation circuit is configured to introduce a compensation pole that can track a parasitic equivalent series resistance (ESR) zero, wherein respective frequencies associated with zero and the pole are dependent upon a routing impedance between the regulated power supply node and the load circuit.

4. The circuit of claim 1, wherein the gain control circuit is configured to bias the first resistor and a second resistor coupled to the first resistor to respective voltage levels that are independent of an output current.

5. The circuit of claim 4, wherein the gain control circuit includes a current mirror configured to generate first and second currents having equal current densities such that no current flows through the first and second resistors.

6. The circuit of claim 4, wherein the gain control circuit includes a current mirror configured to generate first and second currents having equal current densities such that respective voltages across the first and second resistors are independent with respect to variations in the current sourced to the regulated power supply node.

7. The circuit of claim 1, wherein a pole of the pole-zero pair has a respective frequency less than a unity gain frequency of the circuit, and wherein a zero of the pole-zero pair has a respective frequency greater than the unity gain frequency.

8. The circuit of claim 1, wherein the output circuit includes a transistor arranged to form a current mirror that is configured to generate the current to the regulated power supply node based on a modified control signal, wherein the modified control signal is generated, based on the control signal, by the gain control circuit.

9. A method comprising:

sourcing, by a voltage regulator circuit, a current to a regulated power supply node;

performing a comparison of a voltage level of the regulated power supply node to a reference voltage;

adjusting a value of the current using results of the comparison;

stabilizing, using the results of the comparison, a frequency response of the voltage regulator circuit using at least one compensation pole whose frequency is based on an impedance of a route coupling the voltage regulator circuit to a load circuit, wherein stabilizing the frequency response of the voltage regulator circuit includes a compensation circuit generating a first control signal based on the comparison and further comprises providing the first control signal to a gain control circuit; and controlling a frequency response of the gain control circuit using a pole-zero pair whose respective frequencies are based on a first resistor and a capacitor coupled across the first resistor.

10. The method of claim 9, wherein stabilizing a frequency response of the voltage regulator circuit further comprises using at least one compensation zero having a frequency that is dependent on the frequency of the compensation pole, wherein a frequency of the compensation zero is less than the frequency of the compensation pole.

11. The method of claim 9, further comprising:

generating, based on the first control signal and using the gain control circuit, a second control signal;

an output circuit sourcing the current to the regulated supply voltage node based on the second control signal.

12. The method of claim 9, further comprising the gain control circuit adjusting a voltage-to-current gain based on the first control signal.

13. The method of claim 9, further comprising:

controlling a bandwidth of the voltage regulator circuit by biasing voltages across first and second resistors of the gain control circuit to values independent of the current to the regulated power supply node.

14. The method of claim 9, wherein a pole of the pole-zero pair has a respective frequency less than a unity gain frequency of the circuit, and wherein a zero of the pole-zero pair has a respective frequency greater than the unity gain frequency.

15. An apparatus, comprising:

a feedback circuit configured to generate a feedback signal using a voltage level of a regulated power supply node;

an error amplifier circuit configured to generate an error signal using the feedback signal and a reference voltage;

a compensation circuit coupled to the regulated power supply node via a capacitor, wherein the compensation circuit is configured to modify the error signal, using the voltage level of the regulated power supply node, to generate a first control signal;

an output circuit configured to source a current to the regulated power supply node, wherein a value of the current is based on a value of the first control signal; and a gain control circuit configured to generate a second control signal based on the first control signal, wherein the gain control circuit is coupled to provide the second control signal to the output circuit, wherein the gain control circuit includes first and second resistors coupled in series between respective gate terminals of first and second transistors coupled to a first current mirror configured to cause respective current densities through the first and second transistors to be equal such that respective voltages across the first and second resistors are independent with respect to variations in the current to the regulated power supply node.

16. The apparatus of claim 15, further comprising a capacitor coupled in parallel with the first resistor, wherein the capacitor is configured to implement a pole at a first frequency and a zero at a second frequency greater than the first frequency.

17. The apparatus of claim 16, wherein the pole has a frequency that is less than a unity gain frequency of the apparatus, and wherein the zero has a frequency that is greater than the unity gain frequency.

18. The apparatus of claim 15, wherein the output circuit comprises a third transistor coupled to the current mirror and further having a drain terminal coupled to the regulated supply voltage node.

19. The apparatus of claim 15, wherein the compensation circuit includes a second current mirror, wherein the capacitor is coupled between the current mirror and the regulated supply voltage node.

20. The apparatus of claim 15, wherein the output circuit includes a transistor that forms a second current mirror that is configured to generate the current to the regulated power supply node based on the second control signal generated by the gain control circuit.

* * * * *